US010400458B1

(12) United States Patent
Moeller

(10) Patent No.: US 10,400,458 B1
(45) Date of Patent: Sep. 3, 2019

(54) INTERLOCKING FLOORING SYSTEM USING LOCKING STRIPS

(71) Applicant: David W Moeller, Flowery Branch, GA (US)

(72) Inventor: David W Moeller, Flowery Branch, GA (US)

( * ) Notice: Subject to any disclaimer, the term of this patent is extended or adjusted under 35 U.S.C. 154(b) by 0 days.

(21) Appl. No.: 15/932,111

(22) Filed: Feb. 5, 2018

Related U.S. Application Data

(60) Provisional application No. 62/600,013, filed on Feb. 10, 2017.

(51) Int. Cl.
*E04F 15/02* (2006.01)
*E04F 15/04* (2006.01)
*E04F 13/08* (2006.01)

(52) U.S. Cl.
CPC .... *E04F 15/02038* (2013.01); *E04F 13/0894* (2013.01); *E04F 15/04* (2013.01); *E04F 2201/0107* (2013.01); *E04F 2201/0115* (2013.01); *E04F 2201/023* (2013.01); *E04F 2201/0511* (2013.01); *E04F 2201/0535* (2013.01); *E04F 2201/0547* (2013.01)

(58) Field of Classification Search
CPC ..... E04F 15/02038; E04F 15/04; E04F 2201/023; E04F 2201/0547; E04F 2201/0115; E04F 2201/0535; E04F 13/0894; E04F 2201/0511; E04B 5/00
See application file for complete search history.

(56) References Cited

U.S. PATENT DOCUMENTS

| | | | | |
|---|---|---|---|---|
| 187,740 | A * | 2/1877 | Waters | E04F 15/04 52/586.1 |
| 1,412,506 | A * | 4/1922 | Carter | E04F 15/04 411/439 |
| 1,764,331 | A | 2/1929 | Moratz | |
| 1,723,306 | A * | 8/1929 | Sipe | E04B 1/615 211/182 |
| 1,799,729 | A * | 4/1931 | Cadwallader | E04F 15/04 52/586.1 |
| 2,088,238 | A | 6/1935 | Greenway | |
| 2,227,878 | A | 4/1938 | Crooks | |
| 6,029,416 | A | 2/2000 | Andersson | |
| 6,324,809 | B1 | 12/2001 | Nelson | |
| 6,763,643 | B1 * | 7/2004 | Mårtensson | E04F 15/02 52/403.1 |
| 6,804,926 | B1 | 10/2004 | Eisermann | |
| 6,808,777 | B2 | 10/2004 | Andersson | |
| 6,823,638 | B2 | 11/2004 | Stanchfield | |
| 6,922,965 | B2 | 8/2005 | Rosenthal | |
| 7,707,793 | B2 | 5/2010 | Moriau | |
| 8,631,622 | B2 | 1/2014 | Baert et al. | |

(Continued)

FOREIGN PATENT DOCUMENTS

WO WO-2012079210 A1 * 6/2012 ..... E04F 15/02038

*Primary Examiner* — Adriana Figueroa
*Assistant Examiner* — Jessie T Fonseca
(74) *Attorney, Agent, or Firm* — James K. Poole, Esquire

(57) ABSTRACT

Improved interlocking flooring system that allows for a solid wood floor to be fully finished on all surfaces to provide moisture protection and can be installed over a solid subfloor surface without need for attachment to the subfloor with nails, adhesives or other fastening methods. Adjacent interlocking strips are held securely in place by a plurality of novel asymmetric locking strips.

10 Claims, 7 Drawing Sheets

(56) References Cited

U.S. PATENT DOCUMENTS 9,003,735 B2 * 4/2015 Vermeulen ..... E04F 15/02038 52/582.1
9,657,483 B2 * 5/2017 Pervan ..... E04F 15/02038
9,803,375 B2 * 10/2017 Pervan ..... E04F 15/02
9,932,741 B2 * 4/2018 Cappelle ..... E04F 15/02038
9,945,130 B2 * 4/2018 Nygren ..... E04F 15/02038
2004/0211143 A1 * 10/2004 Hanning ..... E04F 15/02 52/578
2004/0261348 A1 * 12/2004 Vulin ..... E04F 13/18 52/578
2005/0210810 A1 * 9/2005 Pervan ..... E04F 15/04 52/578
2006/0101769 A1 * 5/2006 Pervan ..... E04F 15/02 52/591.1
2006/0179754 A1 * 8/2006 Yang ..... E04F 15/02 52/426
2007/0006543 A1 * 1/2007 Engstrom ..... E04F 15/02 52/582.1
2007/0172688 A1 7/2007 Reichwein et al.
2008/0104921 A1 * 5/2008 Pervan ..... E04F 15/02 52/588.1
2008/0110125 A1 * 5/2008 Pervan ..... E04F 15/02 52/582.2
2008/0134613 A1 * 6/2008 Pervan ..... E04F 15/02 52/582.2
2008/0236088 A1 * 10/2008 Hannig ..... B27M 3/0066 52/592.1
2009/0173032 A1 * 7/2009 Prager ..... F16B 5/0044 52/588.1
2009/0308014 A1 * 12/2009 Muehlebach ..... E04F 15/02 52/592.4
2010/0319291 A1 * 12/2010 Pervan ..... E04F 15/02 52/588.1
2011/0271632 A1 * 11/2011 Cappelle ..... E04F 15/02 52/582.2
2012/0055112 A1 * 3/2012 Engstrom ..... E04F 15/02144 52/582.2
2012/0192521 A1 * 8/2012 Schulte ..... E04F 13/08 52/588.1
2012/0279161 A1 * 11/2012 Hakansson ..... A47B 47/0075 52/588.1
2013/0008117 A1 * 1/2013 Pervan ..... E04F 15/02 52/588.1
2013/0014463 A1 * 1/2013 Pervan ..... E04F 15/02038 52/588.1
2013/0042562 A1 * 2/2013 Pervan ..... E04F 15/02038 52/582.2
2013/0042565 A1 * 2/2013 Pervan ..... E04F 15/02038 52/588.1
2013/0047536 A1 * 2/2013 Pervan ..... B26D 1/14 52/309.1
2014/0000197 A1 * 1/2014 Pervan ..... B27N 3/04 52/309.1
2014/0250813 A1 * 9/2014 Nygren ..... E04F 15/02038 52/309.15
2014/0283466 A1 * 9/2014 Boo ..... E04F 15/02038 52/105
2014/0290173 A1 * 10/2014 Hamberger ..... E04F 13/0894 52/582.2
2015/0000221 A1 * 1/2015 Boo ..... E04C 2/40 52/588.1
2015/0233125 A1 * 8/2015 Pervan ..... E04F 15/02038 52/582.2
2016/0153200 A1 * 6/2016 Pervan ..... E04F 15/102 52/582.2
2016/0333916 A1 * 11/2016 Beaulieu ..... F16B 5/002
2017/0097033 A1 * 4/2017 Hakansson ..... A47B 47/0075
2017/0175400 A1 * 6/2017 Josefsson ..... E04F 15/02038
2017/0234020 A1 * 8/2017 Pervan ..... E04F 15/02038 52/582.2
2017/0254096 A1 * 9/2017 Pervan ..... E04F 15/02038
2017/0342725 A1 * 11/2017 Pervan ..... E04F 15/04
2018/0030738 A1 * 2/2018 Pervan ..... E04F 15/02
2018/0119429 A1 * 5/2018 Schulte ..... E04F 15/02038

* cited by examiner

INTERLOCKING FLOORING SYSTEM USING LOCKING STRIPS

CROSS-REFERENCE TO RELATED APPLICATIONS

This application claims the benefit of my provisional application DWMEV-4P, U.S. Ser. No. 62/600,013 for "IMPROVED INTERLOCKING FLOORING SYSTEM," filed Feb. 10, 2017.

This application is not a result of federally sponsored research or development.

BACKGROUND OF THE INVENTION

1. Field of the Invention

The present invention relates to an improved interlocking floor system designed to produce a solid floor surface from individual pieces without the need to attach the pieces to the underlying surface or structure.

2. Description of Relevant Art

Floors provide a solid surface to safely support the occupants or contents of a structure. In addition to that utilitarian value, they also contribute to the aesthetics of the home and are offered in a variety of decorative designs and materials. Wood in particular has been used as a flooring surface for hundreds of years and has typically been constructed from multiple strips of machined lumber that are attached to the upper face of the structural subfloor.

Prior art such as Moratz, U.S. Pat. No. 1,764,331, Greenway, U.S. Pat. No. 2,088,238, Crooks, U.S. Pat. No. 2,227,878 and others describe floors composed of solid wood strips with custom machined edges that are designed to allow each piece to interlock with a previously secured piece and then once interlocked to be secured using nails or adhesive. The edge profiles described in each of these are designed so that they can be easily machined by feeding the wood strips through a basic moulding machine (a basic moulding machine is fitted with two horizontal shafts, top and bottom face, and two vertical shafts, left and right edge, that hold and rotate custom profiled cutters oriented perpendicular to the movement of the wood strip) which allows them to be produced very efficiently (run rates greater than 100 feet/minute). The edge profiles described are also ones that allow the strips to interlock when a new strip is presented horizontally or is presented at a slight angle above horizontal to the previously placed piece. The wood strips typically have a finish either applied to the top face by the factory or applied to the top face on site after installation. This finish provides protection to the wear surface but the edges and bottom of the strips are left unfinished so that the wood strips can gain or lose moisture. As each strip is individually secured, any change in moisture can result in shrinkage and the resulting enlargement of the gaps between the strips or swelling and the resulting cupping or buckling of the strips. Once installed, the wood strips are strongly held by nails and/or adhesive such that the task of removing the floor is arduous and will result in damage to the wood strips as they must be pried up with a crowbar or similar tool.

Prior art such as Eisermann, U.S. Pat. No. 6,804,926, Stanchfield, U.S. Pat. No. 6,823,638, Rosenthal et. al., U.S. Pat. No. 6,922,965, Moriau et. al., U.S. Pat. No. 7,707,793, Baert et. al., U.S. Pat. No. 8,631,622, and others describe floors composed of composite (typically MDF or HDF) or laminate strips with custom machined edges that are designed to allow each piece to interlock with a previously secured piece. Then once interlocked the pieces are not secured to the substrate so the finished floor floats on the underlying surface. This ability to form a floor without attachment to the substrate is a desirable feature as it allows for easy installation over the concrete slab that is often the bottom or basement floor in a typical house. The edge profiles described in each of these have a complex design so that a basic moulding machine would be incapable of producing them and instead custom machines holding cutters at multiple angles would need to be utilized. The edge profiles described are ones that require the strips to interlock only when a new strip is presented at a specific angle above horizontal. The strips typically have a finish applied to the top face by the factory, but the close fits of the machined edges are such that no finish is applied to them. As such, these edges are subject to exposure to moisture changes which can result in shrinkage or swelling that compromises the quality of the fit between the edges. Liquid spills in particular can result in localized swelling of these machined edges which damages the smooth appearance of the floor. Eisermann, Stanchfield, and Baert et. al. have recognized this deficiency and have described the use of adhesives or protective film applied to the interlocking portions so that the area is sealed to prevent moisture absorption at these unfinished edges.

Prior art such as Nelson, U.S. Pat. No. 6,324,809, Reichwein et. al., US 2007/0172688, and others describe floors with interlocking edges that are composed of water resistant composite or laminate strips. They are designed to allow each piece to interlock with a previously secured piece and then once interlocked the pieces are not secured to the substrate so the finished floor floats on the underlying surface. The edge profiles described in each of these have a complex design so that a basic moulding machine would be incapable of producing them and instead custom machines holding cutters at multiple angles would need to be utilized. These specialized machines must also cut with a high level of precision as the interlocking required very close tolerances between the two edges. The edge profiles described are ones that require the strips to interlock only when a new strip is presented at a specific angle above horizontal. The strips typically have a finish applied to the top face by the factory but the close fits of the machined edges are such that no finish is applied to them. To prevent the edges from shrinking or swelling the body of the strip is made from higher cost materials that are waterproof or have high water resistance.

Prior art such as Andersson, U.S. Pat. No. 6,029,416, Andersson et. al., U.S. Pat. No. 6,808,777, and others have described floors made of strips with interlocking edges profiles that are simple in design so that they can be easily machined by feeding the wood strips through a basic moulding machine. To facilitate the interlocking of these simple profiles, one or more strips of flocked material are applied to the faces of the edge profiles that are parallel or nearly parallel to the faces of the flooring strips. This flocked material provides the grip required to hold the two edges together, but does not prevent moisture reaching the edges of the strips and any resulting swelling or shrinkage of the strips.

In view of the foregoing disadvantages and limitations found in the prior art of producing an interlocking floor that is floating, there is need for an improved interlocking floor system.

SUMMARY

An improvement is provided to the existing interlocking floor systems by starting with flooring strips made from pieces of solid wood. Using solid wood offers the advantage of a natural and renewable material, solid wood does not contain formaldehyde containing binders that are often used in the MDF and HDF portions of laminate flooring, and is more readily available and economical than waterproof or water resistant polymer materials.

The flooring strips are machined to have a specific tongue profile cut into one edge and a specific groove profile cut into the opposite edge. The tongue and groove profiles are designed to be produced simultaneously by a single basic high-speed moulding machine so that no specialized equipment is required and they can be produced efficiently. The tongue and groove designs are also ones that need to be machined with standard tolerances (+/−0.010") as there is no close fit between them. The ends of the flooring strips can be square cut or machined with a basic tongue and groove profile so that the ends will also join together with a clearance fit.

After machining, the flooring strip has finish applied to all surfaces by the use of a vacuum coater or multi-head spraying system. The finish may be any one of a number of commercially available wood finishes that provide water protection and may be clear, opaque or colored to provide the desired final finish. The finish then dries and/or cures and provides not only the final appearance of the face of the floor but also seals all the surfaces of the flooring strip so it will not gain or lose moisture.

The interlocking of the machined edges of a series of flooring strips to form a floor is accomplished by use of multiple short pieces of a specially shaped locking strip. The cross section of the locking strip is designed to be inserted into and on top of the tongue profile and then interlock with the groove profile when the two are brought together horizontally. The locking strip is typically made from plastic or other flexible and resilient material that provides enough flexibility and strength to accomplish the interlock function. With modification to the design, the locking strip could be made using a spring type metal or polymer. The locking strip will typically only be 1" to 2" in length so that it can be made by extruding and then cutting the extrusion into pieces or injection molding it as individual pieces. Individual locking strips will be mounted along the tongue edge of each flooring strips so that they are spaced from 6 to 24 inches apart along the tongue edge. The design of the locking strip is such that it will still interlock the two edges even if there is normal variation in the film thickness of the finish that has been applied to the tongue and groove area. The plastic strips will not damage or otherwise compromise the water resistance of the coating in the areas where they are installed.

The adjacent flooring strips interlocked along their edges with a number of individual shaped locking strips create a uniform flooring surface that maintains its integrity without needing to be secured to the subsurface with adhesives, nails or other mechanical means. The initial flooring strip(s) would be laid with the grooved side flush against the wall, floor molding or other vertical surface, and after installing enough strips interlocking with the adjacent strips to nearly cover the floor area, a final strip can be ripped or split to form a partial width strip which fits flush against the vertical wall surface once it is installed to interlock with the previous strip. This provides for a flush connection with the walls on both sides of the installation rather than having a tongue side of the final strip touching the wall without providing a flush connection. This allows for the flooring surface to be installed over concrete that can't easily be nailed to or as a temporary floor to protect the surface below it without damage. It also allows for the flooring system to be taken up and taken apart at a later date with only the locking strips potentially being damaged in the process. This allows for the same flooring strips to be reinstalled in another location with only the requirement being the replacement of any damaged shaped locking strips.

As a result the known deficiencies of the current interlocking floors are addressed and overcome.

BRIEF DESCRIPTION OF THE DRAWINGS

The invention will be better understood and aspects other than those set forth above will become apparent when consideration is given to the following detailed description and drawings. The same numerals are used to designate like components in these figures. Such description makes reference to the annexed drawing wherein.

DETAILED DESCRIPTION OF PREFERRED EMBODIMENTS

In general, the following description adopts a terrestrial frame of reference, in which the bottom of a component is considered to be the side nearest the floor or earth when in normal use, and the top being the side opposite and facing upward. The term "and/or" is used in the conventional sense, in which "A and/or B" indicates that A or B, or both, may be present.

Figure 1:
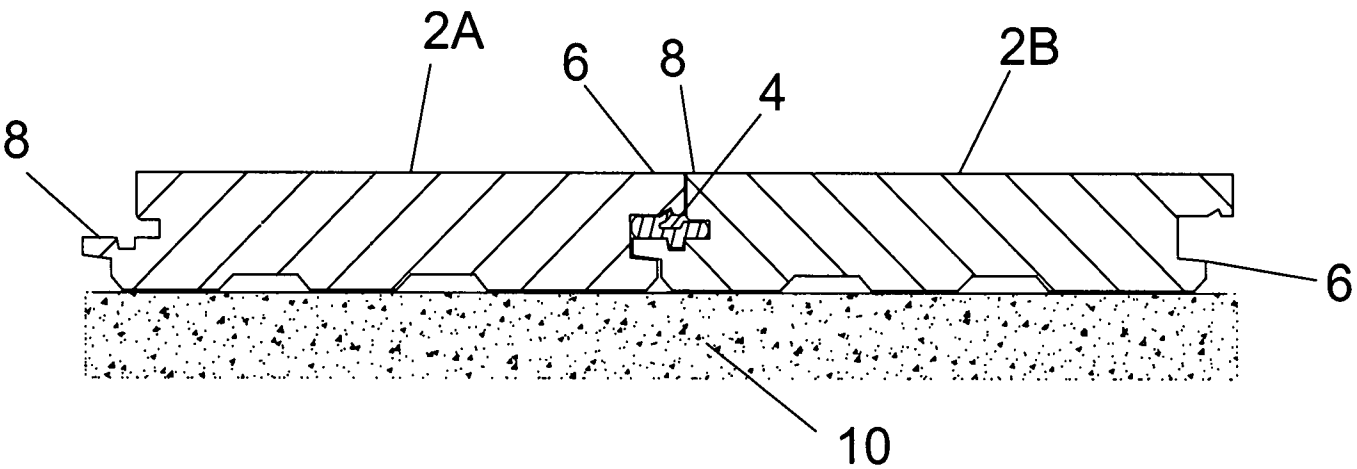
FIG. 1 is a cross section of two adjacent wood strips interlocked with a section of the shaped locking strip as installed over a solid subfloor.

With reference to FIG. 1, two flooring strips (2A & 2B) are shown installed over a solid subfloor surface (10). Each flooring strip (2A & 2B) has a groove profile (6) machined into one edge and a tongue profile (8) of an adjacent strip machined into the opposite edge. The groove profile (6) is designed to overlap the tongue profile (8) and allow clearance for the shaped locking strip (4) to fit in between. The shape of the tongue profile (8) is such that the shaped locking strip (4) can be inserted into it and will become secured in place. The tongue profile (8) with the shaped locking strip (4) secured in place is then inserted into the groove profile (6) edge and the shaped locking strip (4) creates an interlocked joint.

Figure 2:
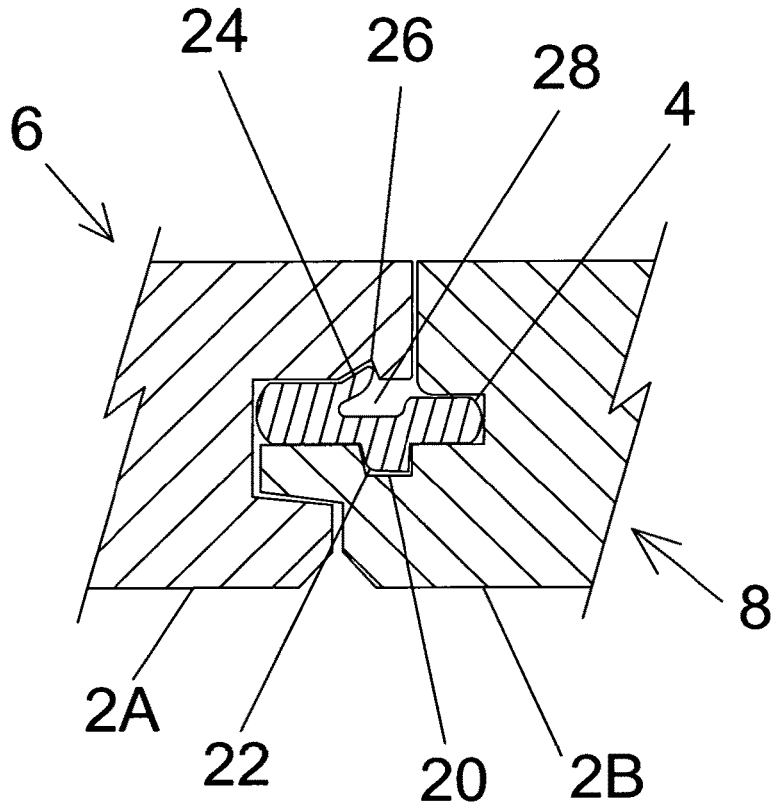
FIG. 2 is a detailed cross section of the interlocking edges of two wood strips and the shaped locking strip.

With reference to FIG. 2, the details of the interlock created by the shaped locking strip (4) between the groove profiled edge (6) and the tongue profiled edge (8) of adjacent flooring strips (2A & 2B) are shown. Specifically, the shaped locking strip (4) is asymmetrical in design and features a solid lower protrusion (22) on the lower surface that is designed to fit into the machined slot (20) that is on the upper face of the tongue profile (8). The upper surface of the shaped locking strip (4) features an upper flexible protrusion (24) on the upper surface that is designed to fit into the machined recess (26) in the underside of the upper face of the groove profile (6). The shaped locking strip (4) has a clearance gap (28) below the upper protrusion (24) so that it can flex downward and allow for the upper face of the groove profile (6) to pass over it to the point that the upper protrusion (24) can return to its raised position and lock into the machined recess (26).

Figure 3:
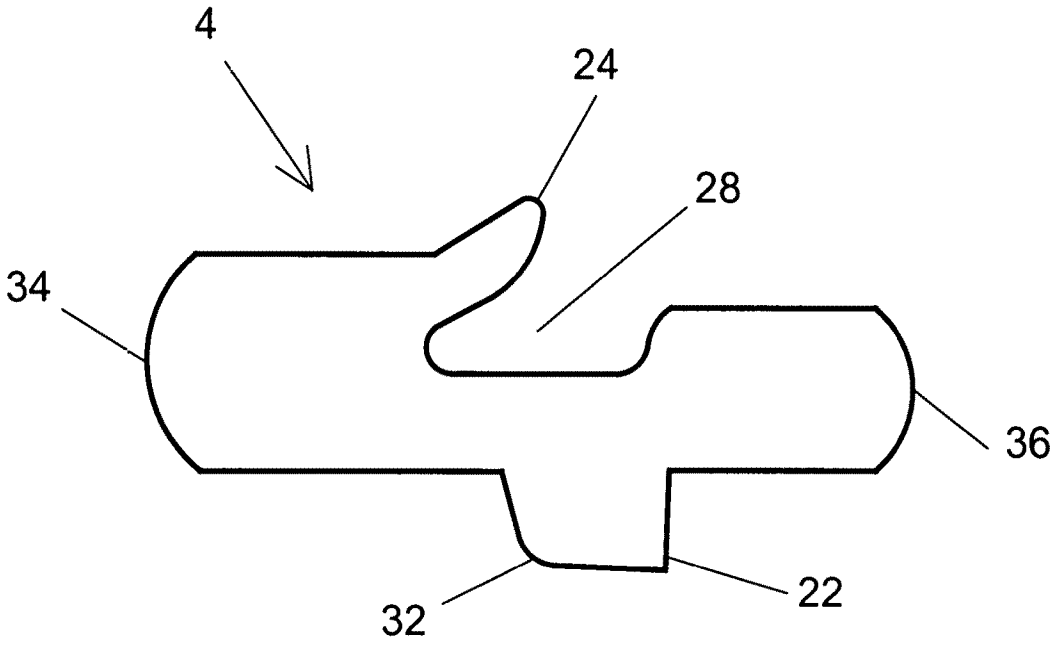
FIG. 3 is an end view of the shaped locking strip.

With reference to FIG. 3, the details of the shaped locking strip (4) are shown. Specifically, the asymmetrical design can be seen with the thick flat edge (34) of the shaped locking strip that fits into the grooved profile of the wood strip (not shown) being thicker than the opposite thin flat edge (36) of the shaped locking strip that fits into the tongue profile of the wood strip (not shown). The solid lower protrusion (22) is shaped with a radius and angled edge (32) to allow for it to slide into and fit into the slot (not shown) that is machined into the upper face of the tongue profile of the flooring strip (not shown) as it is inserted into place. The upper flexible protrusion (24) has a clearance gap (28) below it so that the upper flexible protrusion (24) can flex downward and allow the upper face of the groove profile in the wood strip (not shown) to slide across the upper face of the shaped locking strip (4). The asymmetrical design results in the shaped locking strip (4) being able to only be inserted and seated in the tongue profile of the wood strip (not shown) only in the correct orientation.

Figure 4:
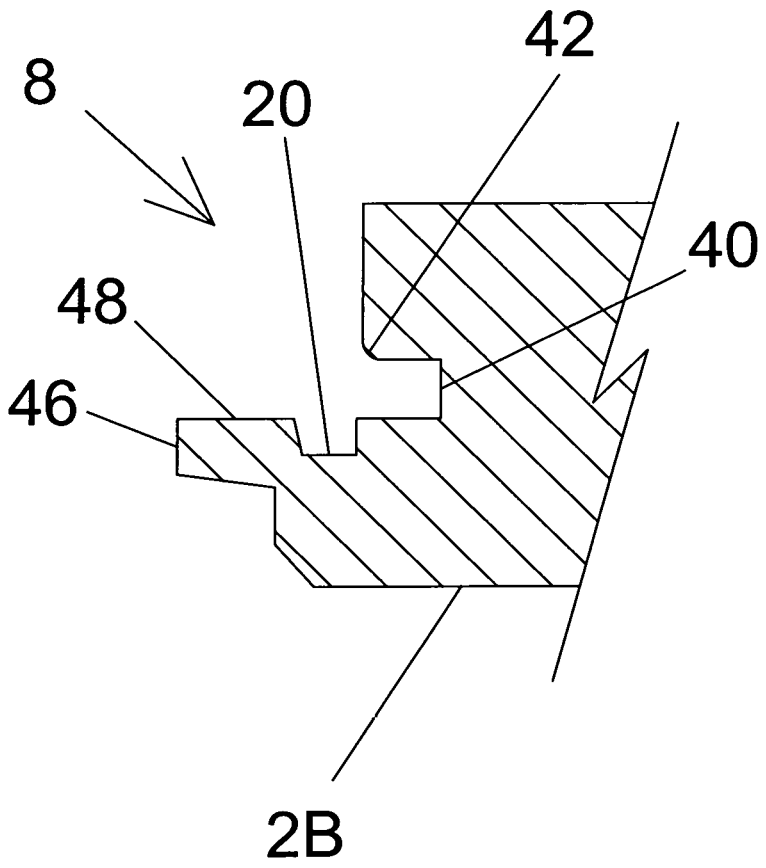
FIG. 4 is a detailed cross section of the tongue edge profile.

With reference to FIG. 4, the details of the tongue profile (8) edge machined into the flooring strip (2B) are shown. The features of the tongue profile (8) shape include a horizontal slot (40) sized and shaped to receive the thinner edge of the shaped locking strip (not shown), a radius corner (42) to allow for clearance as the shaped locking strip (not shown) is inserted into place and a machined slot (20) in the upper face of the tongue profile (48) sized and located to receive the solid bottom protrusion of the shaped locking strip (not shown). In addition to the features designed to work with the shaped locking strip (not shown), there is an extended tongue (46) that overlaps the groove profile (not shown) to force it to align with the tongue profile (8) when they are brought together horizontally. All of the shapes machined are located and oriented so that they can be easily produced with tooling mounted on the vertical and horizontal shafts of a typical moulding machine.

Figure 5:
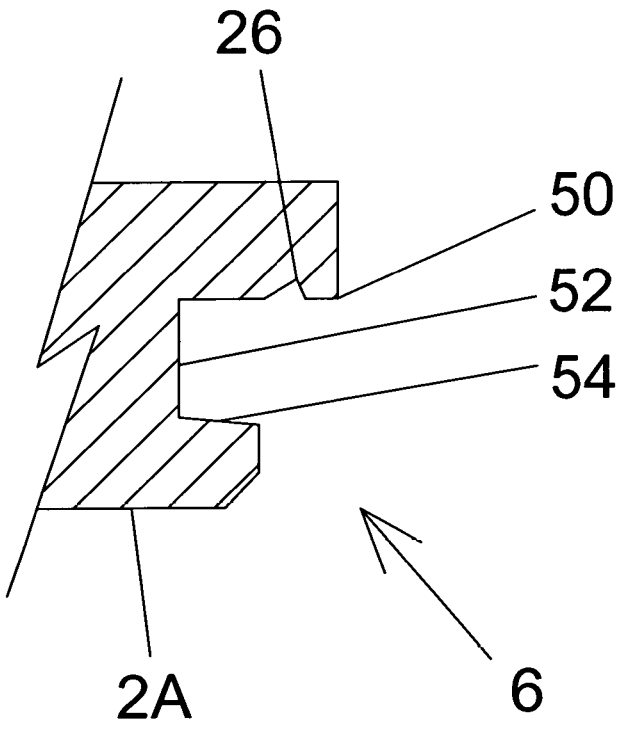
FIG. 5 is a detailed cross section of the groove edge profile.

With reference to FIG. 5, the details of the groove profile (6) edge machined into the flooring strip (2A) are shown. The features of the groove profile (6) shape include a machined recess (26) cut into the underside of the upper face (50) of the groove profile (6) to capture and hold the upper protrusion of the shaped locking strip (not shown), a horizontal slot (52) of the grooved profile (6) sized to receive both the thicker end of the shaped locking strip (not shown) and the extended tongue of the tongue profile (not shown) and the lower face (54) of the groove profile (6) which sits below the extended tongue of the tongue profile (not shown) and forces it to align with the groove profile (6) when they are brought together horizontally. All of the machined shapes are located and oriented so that they can be easily produced with tooling mounted on the vertical and horizontal shafts of a typical moulding machine.

Figure 6B:
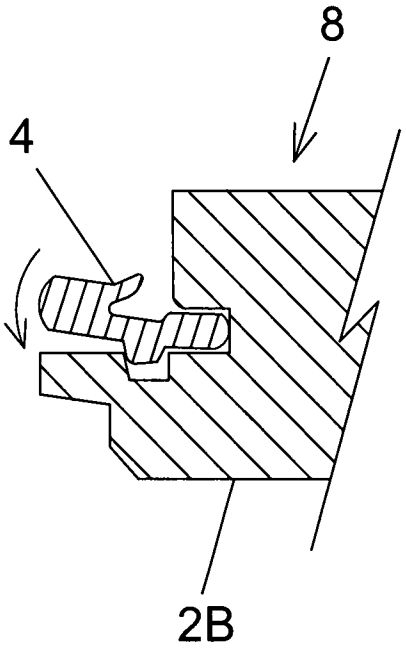
FIGS. 6A and 6B are depictions of the insertion of the shaped locking strip into the tongue edge profile.
Figure 6A:
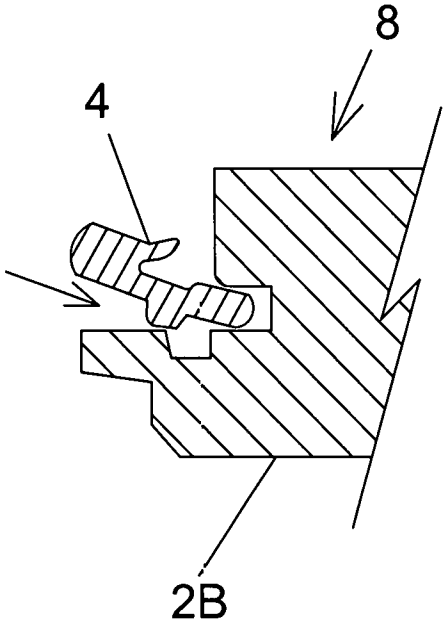

With reference to FIGS. 6A and 6B, the insertion of the shaped locking strip (4) into the tongue profile (8) of the flooring strip (2B) is shown. FIG. 6A shows the shaped locking strip (4) beginning its insertion (arrow indicates direction of movement of shaped locking strip) into the tongue profile (8). FIG. 6B shows the shaped locking strip (4) as it is pivoted down (arrow indicates direction of movement of shaped locking strip) so that it will become fully seated into the tongue profile (8).

Figure 7:
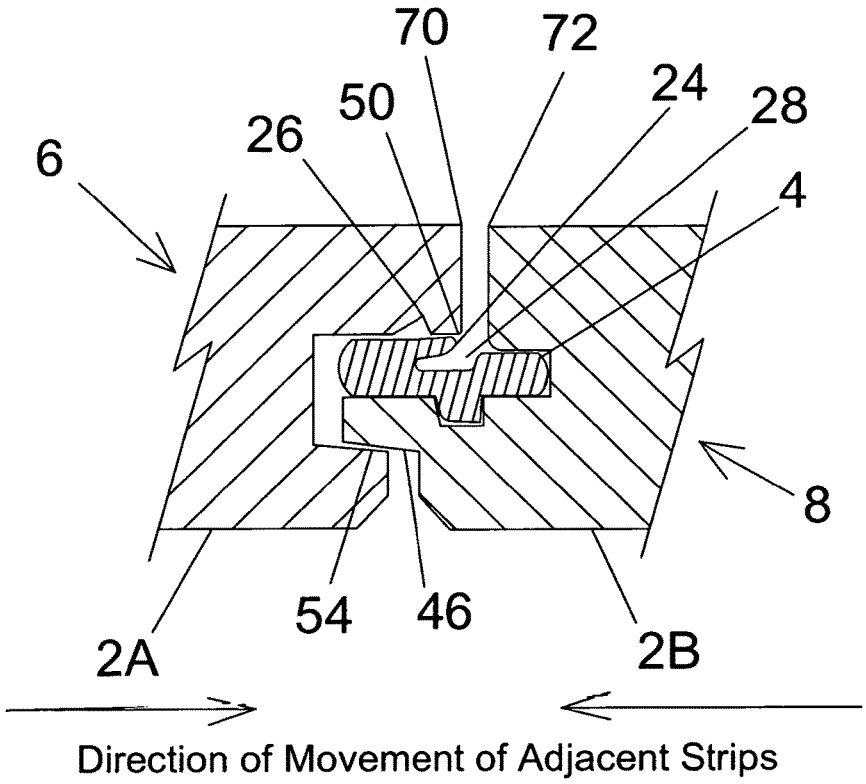
FIG. 7 is a detailed cross section of the tongue and groove profile with the shaped locking strip installed in the process of being connected.

With reference to FIG. 7, the process of connecting two flooring strips (2A & 2B) using the shaped locking strip (4) is shown. The shaped locking strip (4) has been fully seated into the tongue profile (8). The groove profile (6) of the adjacent flooring strip (2A) is being pushed horizontally (arrows indicate direction of movement of the two flooring strips) toward the tongue profile (8) edge of the flooring strip (2B). The extended tongue (46) of the tongue profile (8) overlaps the lower face (54) of the groove profile (6) and keeps the two adjacent flooring strips (2A & 2B) aligned horizontally. The upper face (50) of the groove profile (6) pushes the upper flexible protrusion (24) of the shaped locking strip (4) down and into the clearance gap (28) in the shaped locking strip (4). Once the two adjacent flooring strips (2A & 2B) are brought together fully (the point where the face edge of the groove profile (70) and the face edge of the tongue profile (72) come together and touch), the upper flexible protrusion (24) will come into alignment with the machined recess (26) and will return to its normal upright position to create an interlock between the adjacent flooring strips (2A & 2B).

In the foregoing description, certain terms have been used for brevity, clarity and understanding. All equivalent relationships to those illustrated in the drawings and described in the preferred embodiment are to be encompassed by this present invention to produce the intended results. It is also to be understood that the following claims are intended to cover all of the generic and specific features of the invention herein described, and all statements of the scope of the invention which, as a matter of language, might be said to fall therebetween.

Having thus described and disclosed preferred embodiment of my invention, what I claim as my invention is:

1. An interlocking flooring system comprising a plurality of rectangular flooring strips (2) formed of substantially solid wood, each strip having a tongue profile (8) along one edge, each said tongue profile having an extended tongue (46), and a groove profile (6) along the opposite edge plus a plurality of shaped locking strips (4), each locking strip being shorter than any of said flooring strips and adapted to simultaneously engage with the tongue profile of one of said flooring strips and the groove profile of another of said flooring strips, in a manner such that the two flooring strips are securely mated edge-to-edge by the engagement of said shaped locking strips with the tongue and groove profiles of adjacent pairs of said flooring strips, wherein said tongue profiles comprise a horizontal slot in said one edge of each of said flooring strips, adapted to receive a thin flat edge of said shaped locking strips and said groove profiles comprise open grooves therein and lower faces having bevel edges on bottom corners thereof, with said tongue and groove profiles designed and adapted to mate securely together with the aid of said shaped locking strips inserted therebetween to engage said tongue and groove profiles of the adjacent flooring strips, wherein said shaped locking strips (4) have an asymmetrical cross section comprising solid lower protrusions (22) on the lower surfaces of said shaped locking strips (4) which are designed and shaped to fit into machined slots (20) on upper faces (48) of said tongue profiles (8) of said flooring strips (2) and upper protrusions (24) on upper surfaces of said shaped locking strips (4) designed and shaped to fit into machined recesses (26) on upper faces (50)

of the groove profiles (6) of flooring strips (2) to be mated with the tongue profiles (8) of the adjacent flooring strips (2).

2. The flooring system of claim 1 wherein said shaped locking strips (4) further comprise gaps (28) below said upper protrusions (24), said gaps (28) being positioned to allow said upper protrusions (24) to flex downward during mating of said flooring strips (2) so that said upper faces (50) of said groove profiles (6) can pass over said upper protrusions (24) of said shaped locking strips (4) during the mating to the point that said upper protrusions (24) can return to their original raised positions and lock into said machined recesses (26) on the upper surfaces (50) of said groove profiles (6).

3. The flooring system of claim 1 wherein said solid lower protrusions (22) on said lower surfaces of said shaped locking strips (4) are designed and shaped to allow them to fit into said machined slots (20) on the upper faces (48) of said tongue profiles (8) of each flooring strip (2).

4. The flooring system of claim 1 wherein said asymmetrical cross section having one end thicker than the other, with portions (34) of said locking strips which fit into the grooved profiles (6) of said flooring strips (2) being thicker than the opposite, thinner ends (36) of said shaped locking strips (4) which fit into the tongue profiles (8) of said flooring strips (2) so that said shaped locking strips (4) can fit between said adjacent pairs of said flooring strips (2) in only one configuration to secure the flooring strips (2) firmly together.

5. The interlocking flooring system of claim 4 wherein the tongue profiles (8) are machined into said one edge of each flooring strip (2) to include said horizontal slots (40) which are sized and shaped to receive thinner edges (36) of said shaped locking strips (2) and radius corners (42) adjacent said horizontal slots (40) to allow for clearance as said shaped locking strips (4) are inserted into place and the slots (20) on the upper faces (48) of said tongues (46) which are sized and located to receive the solid bottom protrusions (22) of said shaped locking strips (4).

6. The interlocking flooring system of claim 1 wherein said groove profiles, shapes (6) of said flooring strips further comprise a horizontal slot (52) adapted to receive both an edge (34) of each said shaped locking strip (4) and the extended tongues (46) of the tongue profiles of said adjacent flooring strips (2), and lower sections (54) of the groove profiles (6) of the flooring strips (2) fit below said extended tongues (46) of said tongue profiles (8) and force said extended tongues to align vertically with said groove profiles (6).

7. The flooring system of claim 4 wherein said flooring strips with said tongue (8) and groove profiles (6) are adapted to fit together securely with minimum space between adjacent upper edges (70 and 72) when mated with said locking strips engaged to form said flooring system with said locking strips engaged therebetween.

8. The interlocking flooring system of claim 1 wherein each flooring strip (2) has a finish that provides water protection applied to all surfaces after said tongue profiles (8) and said groove profiles (6) are machined into the edges of said flooring strips (2).

9. The flooring system of claim 1 wherein said shaped locking strips (4) are formed by extrusion or molding.

10. The interlocking flooring system of claim 1 wherein said locking strips comprising a first portion having a rounded end and said upper protrusion comprising a flexible protrusion, with a groove below said flexible protrusion, a second portion at the opposite end from said first portion, also having a rounded end but a thickness less than that of said first portion, and each of said lower protrusions having a trapezoidal projection on the lower surface between said first and second portions, the entire asymmetric cross section being designed and adapted to allow said locking strips to fit between and interlock with the tongue and groove profiles of said flooring system.

* * * * *